US008151867B2

(12) United States Patent
Eriksson et al.

(10) Patent No.: US 8,151,867 B2
(45) Date of Patent: Apr. 10, 2012

(54) CONTINUOUS CASTING DEVICE

(75) Inventors: Boo Eriksson, Vasteras (SE); Jan-Erik Eriksson, Vasteras (SE); Christopher Curran, Courtice (CA)

(73) Assignee: ABB AB (SE)

( * ) Notice: Subject to any disclaimer, the term of this patent is extended or adjusted under 35 U.S.C. 154(b) by 0 days.

(21) Appl. No.: 13/163,400

(22) Filed: Jun. 17, 2011

(65) Prior Publication Data

US 2011/0297345 A1 Dec. 8, 2011

Related U.S. Application Data

(63) Continuation of application No. PCT/EP2008/067795, filed on Dec. 17, 2008.

(51) Int. Cl.
*B22D 11/115* (2006.01)

(52) U.S. Cl. ..... 164/502; 164/503; 164/450.5; 164/468

(58) Field of Classification Search ..... 164/151.3, 164/154.4, 413, 450.5, 453, 454, 466–468, 164/498, 499, 502–504
See application file for complete search history.

(56) References Cited

U.S. PATENT DOCUMENTS 4,530,404 A * 7/1985 Vives ..... 164/467
4,796,687 A 1/1989 Lewis et al.
5,085,265 A * 2/1992 Yamamoto et al. ..... 164/468
6,494,249 B1 * 12/2002 Kollberg et al. ..... 164/452

FOREIGN PATENT DOCUMENTS

EP 0448113 B1 9/1991

OTHER PUBLICATIONS

International Search Report and Written Opinion of the International Searching Authority; PCT/EP2008/067795; Sep. 3, 2009; 9 pages.

* cited by examiner

*Primary Examiner* — Jessica L Ward
*Assistant Examiner* — Kevin E Yoon
(74) *Attorney, Agent, or Firm* — St. Onge Steward Johnston & Reens LLC

(57) ABSTRACT

A continuous casting device, including a mould, an electromagnetic device arranged outside the mould and arranged to provide an electromagnetic field acting on a melt in the mould, the electromagnetic device being supplied with electric current includes a base frequency and harmonics, and thereby providing a first electromagnetic field based on the base frequency and a second electromagnetic field based on the harmonics, and an inductive sensor, arranged at the mould for the purpose of sensing the position of a meniscus of the melt, and operating at frequencies corresponding to the harmonics. The continuous casting device includes at least one screen between the electromagnetic device and the sensor, and the screen is arranged so as to prevent the second electromagnetic field from disturbing the operation of the sensor but to permit the first electromagnetic field to act on the melt in the region of the meniscus.

16 Claims, 2 Drawing Sheets

CONTINUOUS CASTING DEVICE

CROSS-REFERENCE TO RELATED APPLICATIONS

The present application is a continuation of pending International patent application PCT/EP2008/067795 filed on Dec. 17, 2008 which designates the United States, the content of which is incorporated herein by reference.

FIELD OF THE INVENTION

The present invention relates to a continuous casting device, comprising a mould, an electromagnetic device arranged outside the mould and arranged to provide an electromagnetic field acting on a melt in the mould, said electromagnetic device being supplied with electric current comprising a base frequency and harmonics, and thereby generating a first electromagnetic field based on the base frequency and a second electromagnetic field based on said harmonics, and an inductive sensor, arranged at the mould for the purpose of sensing the position of a meniscus of said melt, and operating at frequencies corresponding to said harmonics. Typically, the electromagnetic device forms a so-called electromagnetic stirrer arranged to stir the melt in mould. Typically, said base frequency is in the range of 0.5-10 Hz, while said harmonics might be in the range of several hundred Hz, for example in the range 700-900 Hz. A typical operating frequency of an inductive sensor may be, for example, 800 Hz. An electromagnetic device according to the invention typically comprises at least one iron core on which there is provided windings that are supplied with an alternating current presenting said base frequency and harmonics. The supply of harmonics is, normally, due to the provision of a frequency converter connected to and supplying the electromagnetic device with electric power.

BACKGROUND OF THE INVENTION

The use of so-called electromagnetic stirrers for the purpose of stirring a melt in a mould in a continuous casting device forms contemporary technique well known to the person skilled in the art. Preferably, a part of the melt including the region of the meniscus thereof is to be stirred by means of such an electromagnetic stirrer. However, in certain cases, in which there is a risk of having inclusions brought down into the melt due to the presence of stirring at the meniscus, prior art suggests the use of a screen impermeable to the electromagnetic field of the stirrer, in order to suppress stirring in the region of the meniscus.

In order to control the casting process it is also well known to use an inductive sensor in order to monitor the level of the meniscus of the melt. Typically, such a sensor comprises two coils, one for inducing an eddy current in the melt and another one for sensing said eddy current. The sensor may, typically, be supplied with current high frequent current, for example alternating current of 800 Hz.

Also for reasons well known to the person skilled in the art, frequency converters have become widely used for supplying electromagnetic stirrers with the alternating current with which they are to operate, normally 0.5-10 Hz. However, frequency converters will result in the supply of harmonics, i.e. current of high frequency, on top of the base frequency with which they supply the stirrer. The applicant has realised that the electromagnetic field generated by said harmonics may disturb the operation of inductive sensors used for monitoring the height of the meniscus.

The problem to be solved by the invention is to provide a continuous casting device that permits an effective stirring of a melt in a mould thereof while at the same time permitting a correct measurement of the height of a meniscus by means of an inductive measurement sensor arranged at the mould.

In particular, stirring in the region of the meniscus of a melt in the mould of the device by means of the electromagnetic stirrer should be permitted.

SUMMARY OF THE INVENTION

The object of the invention is achieved by means of the continuous casting device initially defined, characterised in that said continuous casting device comprises at least one screen provided between the electromagnetic device and the sensor, and that said screen is arranged so as to prevent the second electromagnetic field from disturbing the operation of the sensor but to permit the first electromagnetic field to act on the melt in the region of the meniscus. Normally, said harmonics generating the second electromagnetic field has a higher frequency than the base frequency. The screen is located between the electromagnetic device and the sensor such that it will dampen the effect of the second electromagnetic field extending directly from the electromagnetic device towards the sensor. Preferably, the sensor is located in the region of an upper end of the mould. Normally, an upper end of the electromagnetic device ends at a level below the level at which the sensor is located. Accordingly, the screen may extend in a lateral direction above the electromagnetic device in order to screen off the latter from the sensor. The screen may also extend downwards in a vertical or nearly vertical direction from an upper end of the electromagnetic device. Preferably, the screen is formed by a sheet extending in a vertical direction and having a flange extending horizontally above an upper end of the electromagnetic device. It should be understood that the electromagnetic device normally comprises a number of poles formed by windings through which electric current is conducted. There may be one or more cores on which said poles are arranged. According to one embodiment the core is circular and continuously surrounding the mould. According to another embodiment, there electromagnetic device comprises cores provided on opposite sides of the mould.

In order to achieve the object of the invention said screen has a thickness below the magnetic permeable depth for said first electromagnetic field and above at least 50% of the magnetic permeable depth for said second electromagnetic field. Thereby a sufficient dampening of the second electromagnetic field may be achieved in order not to disturb the operation of the sensor. According to a preferred embodiment, the thickness is, however, above the magnetic permeable depth of the second electromagnetic field, thereby ensuring that the dampening be sufficient. The magnetic permeable depth $\delta$ may be expressed as $\delta=[2/(\mu\omega\sigma)]^{1/2}$, wherein $\mu$ is the magnetic permeability of the screen material, $\omega$ is angle frequency and $\sigma$ is electric conductivity of the screen material. Thus the magnetic permeable depth is proportional to both the magnetic permeability of the screen material and the electric conductivity thereof, and it decreases with increasing frequency of the electromagnetic field. Accordingly, for a material with a given magnetic permeability and electric conductivity, the magnetic permeable depth will be higher for a low frequency electromagnetic field than for a high frequency electromagnetic field. Thus, the thickness t of the screen may be expressed as:

$\delta_1>t>\delta_2$, wherein $\delta_1$ is the magnetic permeable depth for the first magnetic field and $\delta_2$ is the magnetic permeable depth of the second magnetic field, i.e. of a magnetic field generated by a current of a frequency corresponding to the operation frequency of the sensor in question. In other words, the thickness may be expressed as $[2/(\mu\omega_1\sigma)]^{1/2}>t>[2/(\mu\omega_2\sigma)]^{1/2}$, wherein $\omega_1$ is the frequency of the current generating the first electromagnetic field and $\omega_2$ is the frequency of the current generating the second electromagnetic field. The total thickness of the screen should be high enough to, in combination with the reduction of the strength of the second electromagnetic field that is due to the distance from the source thereof to the sensor or mold wall, reduce the strength of the second to such at degree that the operative functionality of the sensor is ensured.

According to the invention, the thickness of said screen is such that it reduces the strength of the second electromagnetic field acting on the sensor by at least 90%. Preferably, the thickness of the screen is enough to completely prevent the second electromagnetic field from reaching and affecting the sensor.

Preferably the thickness of said screen is such that it reduces the strength of the first electromagnetic field acting on the melt in the region of the meniscus by not more than approximately 10%. Preferably, the thickness of the screen is low enough to leave the first electromagnetic field unaffected, permitting the latter to interact with its full effect with the melt.

According to one embodiment, the sensor is arranged at a level above an upper end of the electromagnetic device and said screen comprises a sheet extending above an upper end of the electromagnetic device. Said sheet may extend mainly in the vertical direction, or it may extend in a lateral, or horizontal direction above the electromagnetic device. This feature is preferable in those cases in which the sensor is arranged at a lever above the electromagnetic device and it is requested that the second electromagnetic field extending in a upwards direction between the electromagnetic device and the sensor is screened off from the latter.

According to one embodiment, said screen comprises a sheet extending between the electromagnetic device and the mould. A sheet extending between the electromagnetic device and the mould will prevent the second electromagnetic field from inducing an eddy current in the mould. Such an eddy current would, if not suppressed, generate a local electromagnetic field in and end region of the mould, where the sensor is located. Such a field will, accordingly have a frequency corresponding to said harmonics and negative to the function of the sensor. Accordingly, by arranging the screen between the electromagnetic device and the mould such that that it suppresses or prevents the second electromagnetic field from extending to the mould and generating an induced eddy current therein, disturbance of the function of the sensor is further prevented. Still, the screen is arranged so as to permit the first electromagnetic field to reach, and also extend through, the mould wall.

Preferably, the screen screens off a major part of the electromagnetic device from the mould. In other words, the screen should extend over at least half the area from which the second electromagnetic field extends from the electromagnetic device towards the mould.

It is preferred that said screen extends between the electromagnetic device and the mould along at least half the height of the electromagnetic device, and preferably over all the height of the electromagnetic device, thereby completely shielding the mould from the second electromagnetic field.

According to a preferred embodiment, the electromagnetic device extends circumferentially around the mould, wherein the screen extends continuously circumferentially between the electromagnetic device and the mould. Preferably, the screen covers the whole width of the electromagnetic device, in a circumferential direction, between the electromagnetic device and the mould.

According to one embodiment, the electromagnetic device comprises coils provided on opposite sides of the mould, and said screen comprises a separate screen for each coil. Preferably, each screen has a width equal to or larger than the width of its associated coil, and is positioned such that it screens off the entire coil from the mould, or more precisely such that it screens off the magnetic field generated by said coil, irrespective of the whether the actual coil is covered by the screen or not. In other words, the screen should be large enough to form an effective shield between the electromagnetic device and the mould for the preventing the latter from being subjected to said second electromagnetic field.

According to a preferred embodiment, the invention suggests that, at least along a part of said screen, said screen comprises at least two adjacent subscreens separated by a gap. Each subscreen comprises a sheet. Two subscreens overlapping each other and separated by a gap will enhance the dampening effect on the second electromagnetic field more than would a single screen having a thickness corresponding to the sum of the thicknesses of said two subscreens. Accordingly, a subdivision of the screen in two or more subscreens separated by a gap will require less material. The two or more subscreens may be of the same or different composition. Preferably, they are electrically insulated from each other. In this context it should also be mentioned that it is preferred that the screen is electrically insulated from the mould and, preferably, from the electromagnetic device.

As mentioned earlier, the magnetic permeable depth of screen is dependent of the magnetic permeability and the electric conductivity of the screen material. A high magnetic permeable depth will require a less thick and heavy screen. Accordingly, a high magnetic permeability can be compensated by a low electric conductivity and vice versa. According to one preferred embodiment said screen comprises a sheet of a copper-based alloy. According to another preferred embodiment said screen comprises a sheet of a magnetic iron-based alloy. In embodiments in which the screen is subdivided into at least two separated sheets, one of the sheets may comprise a copper-based alloy while the other may comprise an magnetic iron-based alloy. This might be advantageous since the mechanical and physical load may be different for the two or more sheets, wherein in it might be preferred to let one of the sheets take a larger mechanical or physical load than the other.

Further features and advantages of the present invention will be presented in the following detailed description and in the dependent patent claims.

BRIEF DESCRIPTION OF THE DRAWINGS

The invention will now be described by way of example with reference to the annexed drawing on which.

DETAILED DESCRIPTION OF THE INVENTION

Figure 1:
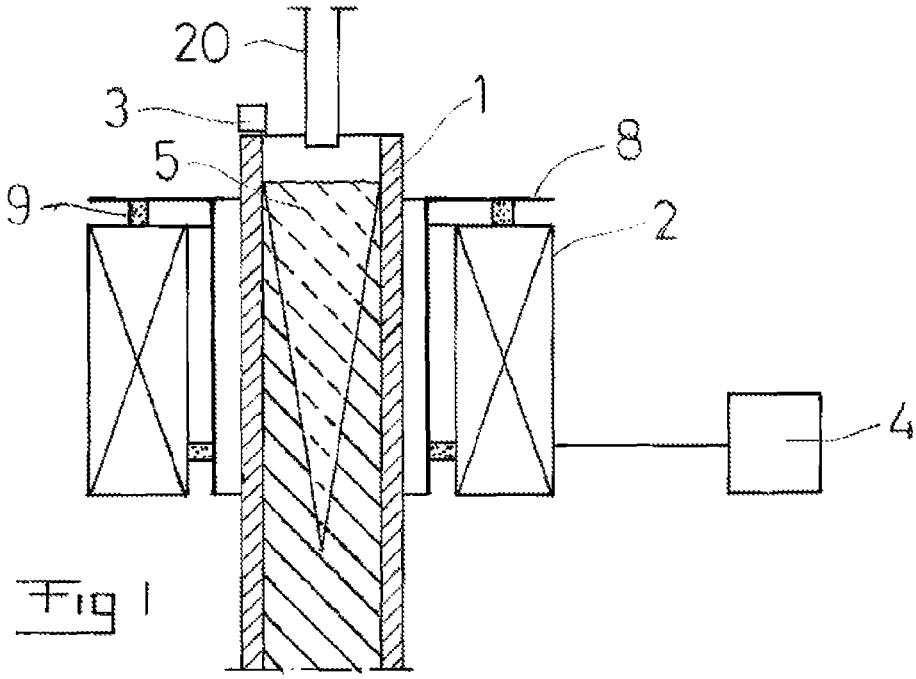
FIG. 1 is a cross-sectional side view of a first embodiment of a part of a continuous casting device according to the invention.

FIG. 1 shows a first embodiment of a continuous casting device according to the invention. Only parts of the device particularly relevant to the invention are shown, and it should be understood that the device may also comprise a plurality of further features regarded as obvious for a person skilled in the art and necessary for the function of such a casting device.

The casting device shown in FIG. 1 comprises a mould 1, an electromagnetic device 2 provided around the mould 1, and a sensor 3 arranged at an upper end of the mould 1. The device also comprises, or is connected to, a frequency converter 4 by means of which electric power is supplied to the electromagnetic device 2. During casting, a melt of molten metal, indicated with reference number 5 in FIG. 1 is charged into the mould through a nozzle, indicated with 20. The sensor 3 is an inductive measurement sensor by means of which the level of the meniscus of the melt 5 is measured during operation. The sensor normally, though not shown in these figures, comprises a couple of coils, wherein one coil is used for generating an eddy current in the melt surface and the other coil is to sense said eddy current and thereby indicate the meniscus level. For this purpose, the sensor 3 is fed with a current of predetermined frequency, for example 800 Hz.

Figure 2:
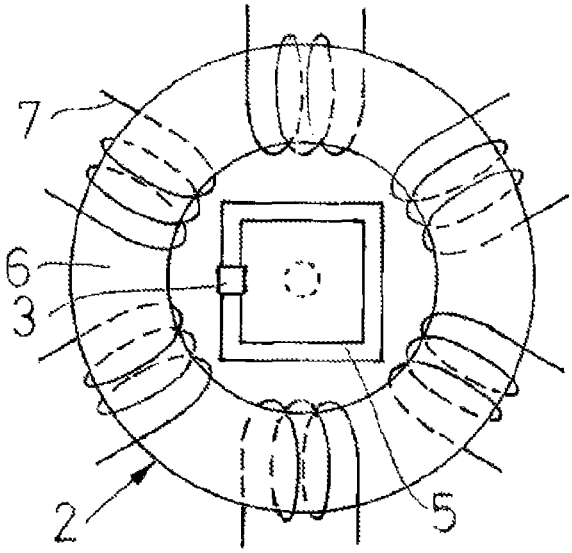
FIG. 2 is a cross-section according to II-II in FIG. 1, showing.

As can be seen in FIG. 2, the electromagnetic device comprises an iron core 6 that, in this specific embodiment, extends circumferentially around the mould 1. Windings 7 are wound around the core in a way known per se and supplied with plural phase, i.e. three-phase, electric current from the frequency converter 4. The current has a base frequency in the range of 0.5-5 Hz, and also, as a result of the inherent properties of the converter 4, presents harmonics, i.e. higher frequencies. During operation thereof, the electromagnetic device 2 will generate a first magnetic field on basis of the base frequency and a second magnetic field on basis of said harmonics. The frequency of the current generating the second magnetic field corresponds to the frequency of the current with which the sensor 3 is fed.

In order to prevent the second magnetic field from disturbing the operation of the sensor 3, either directly or indirectly via an eddy current induced in the mould 1, a screen 8 is positioned between the electromagnetic device 2 and the sensor 3, and between the electromagnetic device 2 and the mould 1. The screen 8 comprises a tubular sheet with a flange extending outwards from the tubular sheet in a radial direction of the latter. Here the flange extends from an end of the tubular part of the screen (see FIG. 3). Preferably, the screen is comprised by a copper-based alloy or a magnetic iron-based alloy. The wall thickness of the screen 8, i.e. the tubular part as well as the flange, is below the magnetic permeable depth of the first magnetic field and above at least 50%, preferably above 100% of the magnetic permeable depth of the second magnetic field. Thereby, the first magnetic field is permitted to fully interact with the melt, thereby stirring the latter, while the second magnetic field is prevented from affecting and disturbing the operation of the sensor 3.

In order to prevent the generation of an eddy current caused by the second electromagnetic field in the mould 1, that would disturb the operation of the sensor 3, the screen 8 extends such that it covers the whole electromagnetic device 2, i.e. the functional part thereof, from the mould 1. Therefore the screen 8 extends from the top of the electromagnetic device 2 to the bottom thereof, thereby shielding the mould 2 completely from said second electromagnetic field.

The screen 8 is attached the electromagnetic device through attachment members, indicated with 9 in FIG. 1. Preferably, the attachment members 9 electrically insulates the screen 8 from the electromagnetic device.

Figure 3:
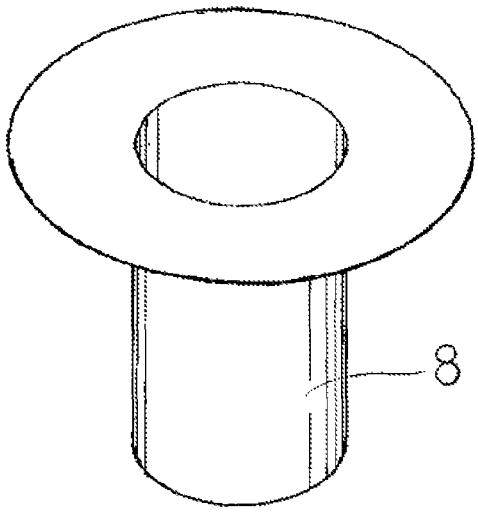
FIG. 3 is a perspective view showing the screen of the device shown in FIGS. 1 and 2.
Figure 4:
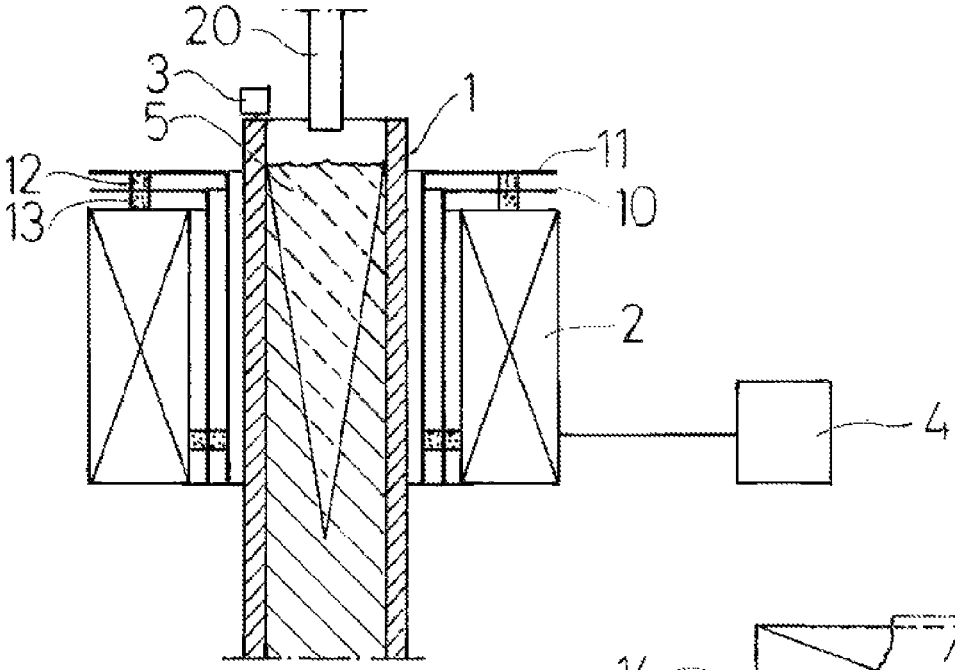
FIG. 4 is a cross-sectional side view corresponding to FIG. 1, but showing an alternative screen design.

FIG. 4 shows a further development of the screen shown in FIGS. 1 and 3. Here, the screen is subdivided into two parallel subscreens or sheets 10, 11 of corresponding shape. The subscreens 10, 11 overlap each other and each of them shields the sensor 3 and the mould from the electromagnetic device. Each subscreen 10, 11 is formed by a tubular sheet with a flange, just like the one shown in FIG. 3. As will be see n later other shapes are possible, depending on the design and position of the electromagnetic device. Attachment members 12, 13 are provided to attach the subscreens 10, 11 to each other and to the electromagnetic device 1 respectively. The attachment members 12, 13 are adapted so as to electrically insulate the subscreens 10, 11 from the electromagnetic device 2 as well as from each other. Accordingly, each subscreen 10, 11 is electrically disconnected from the electromagnetic device 2, the mould 1 and from the other subscreen 11, 10.

Figure 5:
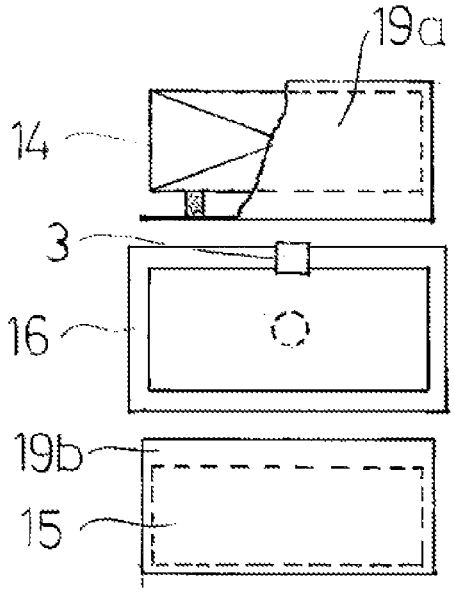
FIG. 5 is a top view of a further embodiment of the casting device of the present invention.

FIG. 5 shows a further embodiment of the invention, in which the electromagnetic device 13 comprises separate iron cores 14, 15 arranged on opposite sides of a mould 16. The mould 16 has a rectangular cross-section for enabling casting of slabs, and the cores 14, 15 are located along the longer sides of the mould 16. On the mould there is provided an inductive measurement sensor 3 like the sensor previously described with regard to FIGS. 1-4, for measuring the level of a meniscus in the mould 16. In a way known per se each core 14, 15 is provided with a coil or winding (schematically indicated with a cross in FIGS. 1, 4, 5 and 6) to which an alternating current is supplied, preferably from a frequency converter (not shown). The supplied current comprises a base frequency and harmonics resulting in a first electromagnetic field by means of which a melt in the mould 16 is stirred, and a second electromagnetic field, caused by said harmonics, that has a frequency that corresponds to the frequency of the field generated by the sensor 3 and therefore could disturb the function of the later. A screen 19 is provided between each core 14, 15 and the mould. The screen 19 is subdivided in two sheets 19*a*, 19*b*, each one covering a respective associated core 14, 15 and shielding the sensor 3 and the mould from a second electromagnetic field of the latter in accordance with the previous teaching of the invention. The thickness of the screen 19 is below the magnetic permeable depth for the first electromagnetic field and above the magnetic permeable depth of the second electromagnetic field. It should be understood that each of the sheets 19*a*, 19*b* may be subdivided into two or more overlapping sheets separated by a gap and, preferably, electrically insulated from each other in accordance with solution presented for the embodiment shown in FIGS. 1-4.

Figure 6:
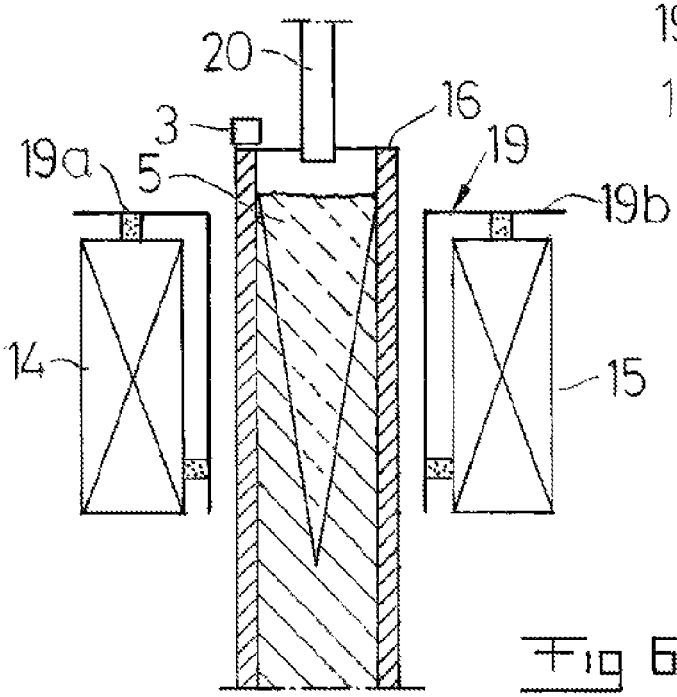
FIG. 6 is a cross-sectional side view of the device shown in FIG. 5.

FIG. 6 is a side view showing the device shown in FIG. 5. Likewise to previous embodiments the screen 19 extends from the upper end of the electromagnetic device 13 to the lower end thereof and presents a lateral flange extending over the upper end of the electromagnetic device 13, thereby shielding both the sensor 3 and the mould 16 from said second electromagnetic field.

What is claimed is:

1. A continuous casting device, comprising a mould, an electromagnetic device arranged outside the mould and arranged to provide an electromagnetic field acting on a melt in the mould, said electromagnetic device being supplied with electric current comprising a base frequency and harmonics, and thereby generating a first electromagnetic field based on the base frequency and a second electromagnetic field based on said harmonics, and an inductive sensor, arranged at the mould for the purpose of sensing the position of a meniscus of said melt, and operating at frequencies corresponding to said harmonics, characterised in that at least one screen is provided between the electromagnetic device and the sensor, and that said screen is arranged so as to prevent the second electromagnetic field from disturbing the operation of the sensor but to permit the first electromagnetic field to act on the melt in the region of the meniscus.

2. A continuous casting device according to claim 1, wherein said screen has a thickness below the magnetic permeable depth for said first electromagnetic field and above at least 50% of the magnetic permeable depth of said second electromagnetic field.

3. A continuous casting device according to claim 1, wherein said screen has a thickness below the magnetic permeable depth for said first electromagnetic field and above the magnetic permeable depth of said second electromagnetic field.

4. A continuous casting device according to claim 1, wherein the thickness of said screen is such that it reduces the strength of the second electromagnetic field acting on the sensor by at least 90%.

5. A continuous casting device according to claim 1, wherein the thickness of said screen is such that it reduces the strength of the first electromagnetic field acting on the melt in the region of the meniscus by not more than approximately 10%.

6. A continuous casting device according to claim 1, wherein said sensor is arranged at a level above an upper end of the electromagnetic device and that said screen comprises a sheet extending above an upper end of the electromagnetic device.

7. A continuous casting device according to claim 1, wherein said screen comprises a sheet extending between the electromagnetic device and the mould.

8. A continuous casting device according to claim 7, wherein said screen screens of a major part of the electromagnetic device from the mould.

9. A continuous casting device according to claim 1, wherein said screen extends between the electromagnetic device and the mould along at least half the height of the electromagnetic device.

10. A continuous casting device according to claim 1, wherein the electromagnetic device extends circumferentially around the mould and that the screen extends continuously circumferentially between the electromagnetic device and the mould.

11. A continuous casting device according to claim 1, wherein the electromagnetic device comprises coils provided on opposite sides of the mould and that said screen comprises a separate screen for each coil.

12. A continuous casting device according to claim 11, wherein each screen has a width equal to or larger than the width of its associated coil, and is positioned such that it screens of the entire coil from the mould.

13. A continuous casting device according to claim 1, wherein at least along a part of said screen, said screen comprises at least two adjacent subscreens separated by a gap.

14. A continuous casting device according to claim 1, wherein said screen comprises a sheet of a copper-based alloy.

15. A continuous casting device according to claim 1, wherein said screen comprises a sheet of a magnetic iron-based alloy.

16. A continuous casting device according to claim 1, characterised in that it is connected to and supplied with current by a frequency converter.

* * * * *